United States Patent [19]

Fischer et al.

[11] 4,099,560

[45] Jul. 11, 1978

[54] OPEN BOTTOM FLOAT TENSION RISER

[75] Inventors: William Fischer, Fullerton, Calif.; Virgil D. Rogge, Sumatra, Indonesia

[73] Assignee: Chevron Research Company, San Francisco, Calif.

[21] Appl. No.: 667,233

[22] Filed: Mar. 15, 1976

Related U.S. Application Data

[63] Continuation of Ser. No. 511,158, Oct. 2, 1974, abandoned.

[51] Int. Cl.[2] ..... E21B 7/12

[52] U.S. Cl. ..... 166/0.5; 61/86; 138/106

[58] Field of Search ..... 175/5–10; 166/0.5, 0.6; 61/86, 69; 138/106, 107

[56] References Cited

U.S. PATENT DOCUMENTS

| | | | |
|---|---|---|---|
| 2,684,575 | 7/1954 | Pryor et al. | 166/0.5 |
| 3,017,934 | 1/1962 | Rhodes et al. | 166/0.5 |
| 3,256,936 | 6/1966 | Johnson et al. | 166/0.6 |
| 3,265,130 | 8/1966 | Watkins | 166/0.6 |
| 3,313,345 | 4/1967 | Fischer | 175/7 X |
| 3,313,347 | 4/1967 | Crain | 166/0.5 |
| 3,359,741 | 12/1967 | Nelson | 166/0.5 X |
| 3,456,745 | 7/1969 | Peri | 175/5 |
| 3,556,231 | 1/1971 | Henderson | 175/27 X |
| 3,855,656 | 12/1974 | Blenkarn | 175/7 X |
| 3,858,401 | 1/1975 | Watkins | 175/7 |

*Primary Examiner*—Ernest R. Purser
*Assistant Examiner*—Richard E. Favreau
*Attorney, Agent, or Firm*—R. L. Freeland, Jr.; Edward J. Keeling

[57] ABSTRACT

A marine riser, which is hung from a drilling platform floating on a body of water and connected at its lower end to a wellhead, is buoyantly tensioned by one or more float cans with open bottoms. These float cans are connected at their upper end to the riser to which air under pressure is controllably supplied. The pressurized air blows out the water in each can to achieve the desired buoyancy. The float can may having an air dump valve interconnected with similar valves in the other cans. The function of these valves is to release the pressurized air in the can if the riser parts. At the upper end of the riser is a slip joint, which may include safety water-dampening gear to further reduce upward motion of a parted riser. The optional dampening gear comprises an annular piston formed by the upper section of the slip joint that forces water through ports in the exterior of the lower section of the slip joint as the riser below the slip joint moves upward. A method of running this riser includes the steps of lowering the riser with or without: the air under pressure flowing into the float cans, a ballast weight at the bottom end of the riser, and supplementary tensioning or motion compensating equipment. The riser's descent may be stopped at a point above a water bottom connector at which time motion compensating equipment may be engaged and then gradually lowered to make the connection. The foregoing is reversed when removing the riser from the water bottom connection.

37 Claims, 16 Drawing Figures

OPEN BOTTOM FLOAT TENSION RISER

This is a continuation division or application Ser. No. 511,158, filed Oct. 2, 1974, now abandoned.

BACKGROUND OF THE INVENTION

1. Field of the Invention

The present invention relates to a method and apparatus for use in offshore drilling and well completion that prevents bending and buckling of marine drilling risers by supplying axial tension to the riser through controllably buoyant open-bottom float cans.

2. Description of the Prior Art

Various types of axially tensioned risers are commonly used. One such device is shown in U.S. Pat. No. 3,017,934, entitled "Casing Support," issued to A. D. Rhodes, et al., on January 23, 1962. In this patented riser, one embodiment has a plurality of float cans or buoyancy pods which decrease in available buoyant volume upwardly from the lowest float can. Each float can is made up of a cylinder open at its lower end with a bell cap at its upper end. The upper bell cap of each float can is connected to the riser in such a way as to provide a pressure-proof connection. A conduit connects the lower end of each float can with the lower end of the succeeding one above it.

A source of compressed air located on a floating vessel is connected to the conduit to supply air under pressure to the lower end of the lowermost float can and then to each succeeding one. The compressed air source is connected to the uppermost float can by a return line. Subsequent to anchoring this riser and after attaining the requisite tension, a continual or periodic introduction of air is provided to compensate for the loss of air which goes into solution with the water at the open-bottom end.

The foregoing arrangement has some inadequacies. Among them is the inability to adjustably control the tensioning of the riser since all the buoyancy pods are filed with compressed air from the bottommost pod to the topmost one. Additionally, this riser does not have a built-in safety feature that comes into operation if the riser should part resulting in uncontrolled movement and subsequent damage. The present invention, on the other hand, can be controllably tensioned. But most importantly, the present invention includes a built-in safety mechanism that can eliminate the costs of both repair and accompanying drilling down time due to damage from an uncontrolled parted riser. Also, the present invention, as will become evident, has the ability to be lowered without being ballasted.

SUMMARY OF THE INVENTION

The present invention includes a marine riser with float cans. The float cans are closed on the top, the end closest to the vessel; the bottom end is open and so affixed to the riser to allow axial expansion and contraction of the can shell relative to the riser conduit. This expansive and contractive movement is due to the temperature differences between the float can shell in the cold ocean water and the riser conduit which carries the much warmer drilling fluid. Also connected to the riser are vanes to guide this movement. The float cans may extend upward almost to the lowest water surface experienced in calm water conditions. If currents, however, are extremely severe, particularly near the surface; the uppermost float can is located below the current. Also supplementary tensioning may be required. In the case where severe known currents exist at other levels, a riser module arrangement with supplementary tensioning but without float cans in the current zone may be used.

A single air dewatering and flooding conduit runs from a source of compressed air located on the drilling vessel down to each floatation can terminating at the bottommost one. The float cans, however, may be connected in separate groups with one conduit for each group.

At a convenient point on the conduit at deck level, the following items are operably connected to the conduit: a pressure regulator, an adjustable buoyancy control valve for controlling pressure and volumetric flow of the compressed air, and an atmospheric vent valve for regulating the escape of air from the float cans.

At each connection of the conduit to the top of the float can (closed upper end), there is an air release check valve and a float-operated air release and delivery valve mounted. These valves are arranged to respond to the setting of the buoyancy control valve and pressure regulator on the vessel in delivering air to or from the float cans. Also in the closed upper end of each float can is an optional safety air dump valve, normally closed against the underside of the upper end, whose function is to release the air in the float cans if there is an accidental parting of the riser. Each dump valve is connected to the adjacent dump valves in the can above and below it by a tag line with the lowest tag line attached to a water bottom connector or the like.

When the riser is lowered into the ocean, the air dewatering and floating conduit is vented. This permits the entrapped air in the cap to rapidly escape allowing water to fill the cans creating a wet riser, i.e., one in which water flows into the float cans eliminating the requirement for any type of ballasting equipment. Similarly, lowering the wet riser is called wet running. The present invention may also be lowered with pressurized gas flowing into the cans; however, ballasting equipment is then required.

The operation of lowering the riser is preferably done on a drill pipe with a vessel motion compensating link or other comparable means. The riser is stopped a short distance above the connecting point and gently lowered for the connection through the controlled relaxation of the motion compensating gear. After the connection is made, dewatering operations are undertaken. This procedure may be modified by stopping the riser a safe distance above a water bottom connector so as to avoid contact with it due to water motion. Initial dewatering is then undertaken to reduce the riser weight in the water to a minimum consistent with supporting the marine riser by both buoyancy and the motion compensating gear at the top of the riser; however, either one of these interim riser supporting procedures can be used separately.

With careful supervision, the lowering operation is accomplishable without the use of motion compensating gear provided there are bumper subs and lateral ties at the top of the riser to keep the riser in proper position relative to the drilling vessel.

During the lowering operation, the float cans are manipulated for neutral buoyancy of the riser just before the bottom connection is made. Specifically, the riser is stopped a safe distance above the water bottom connector so as to avoid contact with it due to water motion; dewatered to achieve neutral buoyancy; and then lowered for connection. Subsequently, dewatering is restarted to increase buoyancy to achieve the necessary tension. The cans below the lowest can dewatered remains wet and does not contribute to the buoyancy support.

Should the buoyancy tensioned riser part for any reason, a torpedo-like effect due to the sudden loss of riser anchorage continuity occurs. In this situation, the air in the float cans above the location of the riser parting is dumped or released by the automatic opening of the air dump valves before the tag line also parts. This torpedo-like effect is further lessened by the use of a slip joint with safety tiedowns which functions as a water dampener due to the action of an annular slip joint piston. The piston expels water through ports. Eventually, the riser below the parting location topples to the ocean floor because of buoyancy losses occurring from the severed air dewatering and flooding conduit.

When the riser is moved from an anchored position, the procedure is similar to the steps outlined above. The following criteria, however, is restated to emphasize its importance. First, the use of motion compensating equipment, establishing neutral buoyancy in the riser, or the combination of the two is preferable in order to take the load off the water bottom connection before disengaging the connection. It is also essential to raise the riser a safe distance above the water bottom connector to prevent impact with it immediately after disconnecting and during the interval the float cans are completely dewatered.

BRIEF DESCRIPTION OF THE DRAWING

Further advantages and embodiments of the present invention will be apparent from the drawings and the description of the preferred embodiment.

FIG. 6 shows an open-bottom float can riser entering the water.

FIG. 7 illustrates the open-bottom float can filling up with water without using a counterweight.

FIG. 8 shows the invention secured to the water bottom connector.

FIG. 9 shows the deflooding of the open bottom float can beginning. The air supply valve is opened and the vent valve is closed.

FIG. 10 illustrates an interim stage of deflooding. The air relief valve in the upper can is closed while the bottom can filled with water is open.

FIG. 11 illustrates the open-bottom float cans completely deflooded.

FIG. 12 and FIG. 13 illustrate the air supply valve closed and the vent valve open. In this arrangement, the open-bottom float cans are in the flooding step.

FIG. 14 illustrates the completion of the flooding step after which the marine riser is removed out of the water upon detachment from the water bottom connection.

DESCRIPTION OF THE PREFERRED EMBODIMENT

Figure 1:
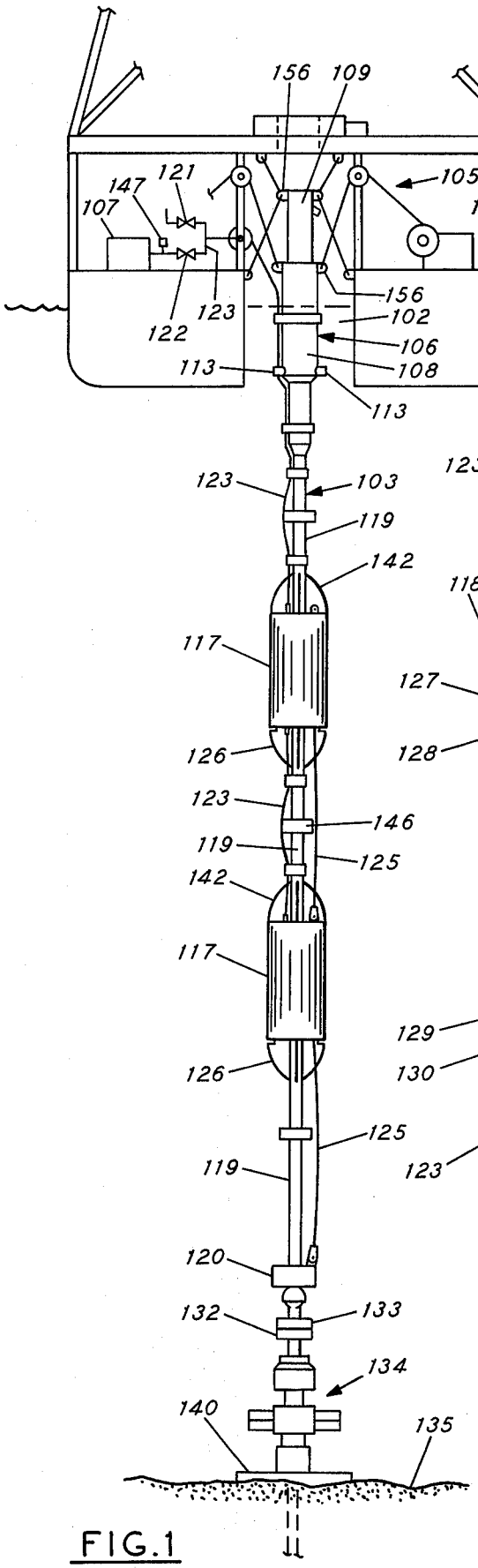
FIG. 1 is an elevation view of the marine drilling riser using two open-bottom float cans. The marine riser is connected to the drilling vessel by a telescopic or slip joint and a supplementary tensioning system. The bottom end of the riser is attached to a water bottom connector.

Referring to FIG. 1, the drilling vessel 100 is floating on a body of water 101 such as the ocean. This invention may also be used with other types of platforms located in the water, for example, fixed or relocatable underwater bottom supported ones.

The drilling vessel 100 has a "moon pool" or well 102 through which the marine drilling riser 103 is passed. Attached to the superstructure 104 above the well 102 is a supplementary tensioning system 105 which is connected to safety tiedowns 156 fastened to the slip joint 106. The supplementary tensioning system 105 is required if currents are extremely severe necessitating interim tensioning. This implies that one side of the tensioning means may be kept slack so as to allow the other side to maneuver the riser into control.

Also located on the vessel 100 is a source of air 107 under pressure; other gases conveniently available having a density less than water may be used instead of air. Examples of such gases are nitrogen which may be stored nearby and used in the case of a breakdown in the air source 107; another is flue or exhaust gas which may be similarly used in an emergency.

Figure 3:
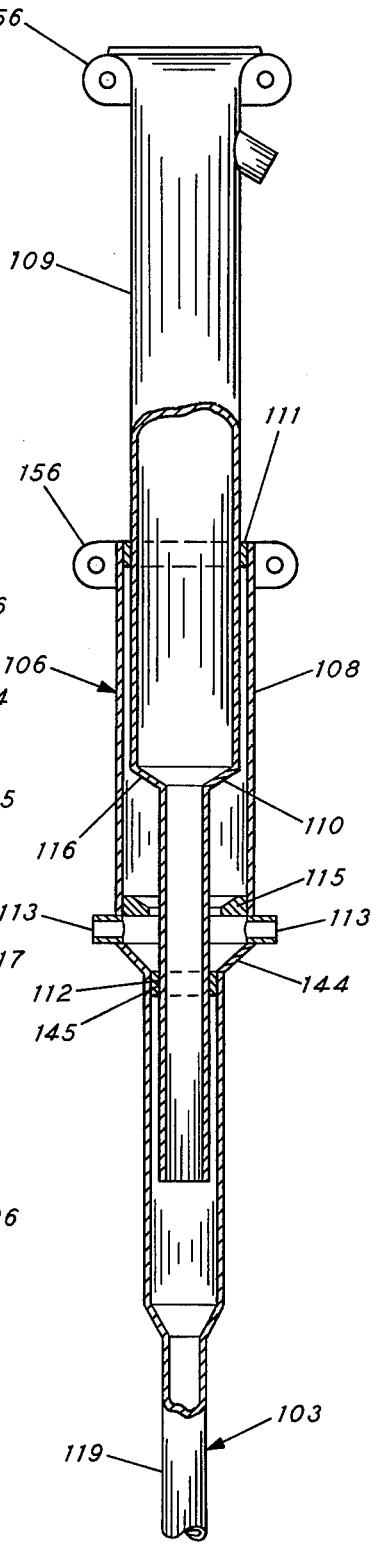
FIG. 3 is a schematic illustration of the upper end of the slip joint connected to the marine drilling riser. In particular, the following are shown: the optional safety type annulus piston and water vent ports which permit the entrance and exit of the water as a dampening fluid.

Immediately below the superstructure 104 is the slip joint assembly 106 made of two sub-assemblies, FIG. 3. The first is the outerbody 108 and the second is a stinger 109. Both are made of a large diameter open-ended upper cylinder fastened to a smaller diameter lower open-ended cylinder, both approximately equal in length and held together respectively by a tapered couplings 110, 144. The dual diameter configuration of the stinger 109 forms an annulus piston 116 providing a dampening effect if the riser 103 parts below the slip joint assembly 106. The clearance between the outer diameter of the upper part of stinger 109 and the inner diameter of the upper part of outerbody 108 are such as will accommodate the necessary guide 111. The circular clearance between the outer diameter of the lower part of stinger 109 and the inner diameter of the lower part of the outer body 108 accommodate the guide 145 and seal 112. The guides 111 and 145 are necessary to maintain axial sliding whereas the seal 112 is required to prevent ocean water mixing with the drilling fluid.

Figure 15:
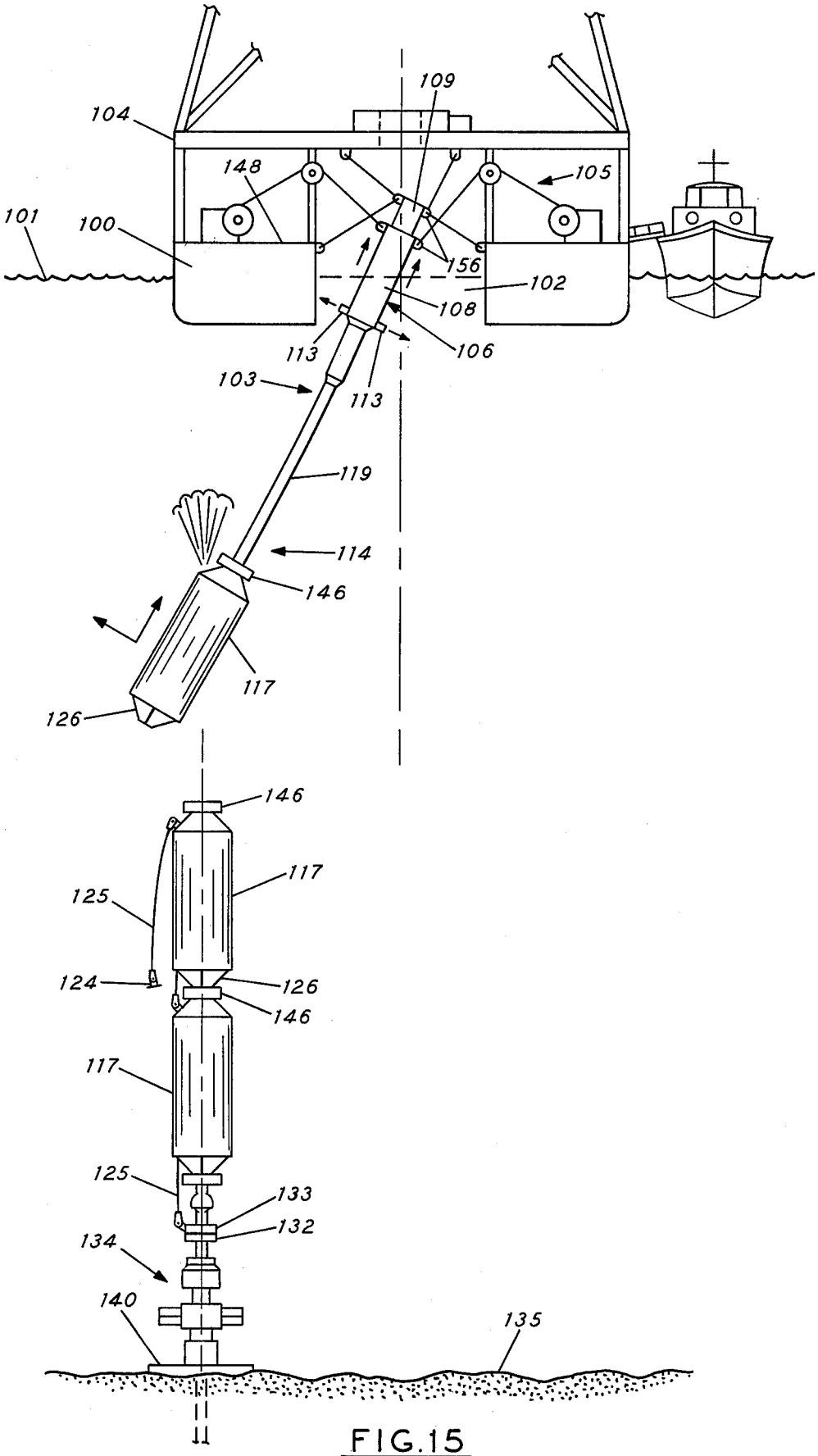
FIG. 15 is a schematic illustration of a riser parting.

As the vessel 100 undergoes vertical motion, the riser 103 goes through a stroking motion which pumps water back and forth both through the port means 113 at the bottom end of the outer body's large diameter section and the annulus clearance at guide 111. With the relatively low velocity of vessel motion, there is no significant increase in resistance to the slip joint stroke. Should a riser parting occur, the ascent of the riser section above the break, 114, FIG. 15, and the outer body 108 of the slip joint 106 is usually sudden; and the severed section 114, without any velocity restraint, would impact with the slip joint stop 115, FIG. 3, at high velocity and a corresponding high load. (The stop 115 is provided both to prevent blocking the port means 113 during the lowermost portion of the slip joint's stroke and to prevent end of stroke contact between the less durable parts, e.g., the tapered couplings 110, 144. One could practice this invention without the stop 115, but relative movement of the outer body 108 and stinger 109 would not be limited.) The necessary restraint to lessen disastrous impact loads is the annulus piston's thrust of water through both the port means 113 and the annulus clearance at guide 111, thus, containing the upward travel velocities within safe limits. The impact is further reduced and possibly eliminated by the air dump valves 124 described later.

Below the slip joint assembly 106 are located several open-bottom float cans 117. Though two float cans 117 are illustrated in FIG. 1, one or any other number of cans 117 may be used to accomplish the requisite riser tensioning, FIG. 4. The cans 117 are preferably fabricated from steel into a cylindrical or rectangular shape but may also be made from plastics and other metals. The head 118 of the can 117 is welded to the marine riser pipe 119 and reinforced with gussets 142 or otherwise secured to the riser pipe 119 to obtain a structural and a pressure-proof joint 136 as in FIG. 2. Such a joint 136 is necessary because the pressure of the fluid required to blow water from the float can 117 and the buoyant forces contributed by the can 117 are exerted against this joint 136.

Figure 5:
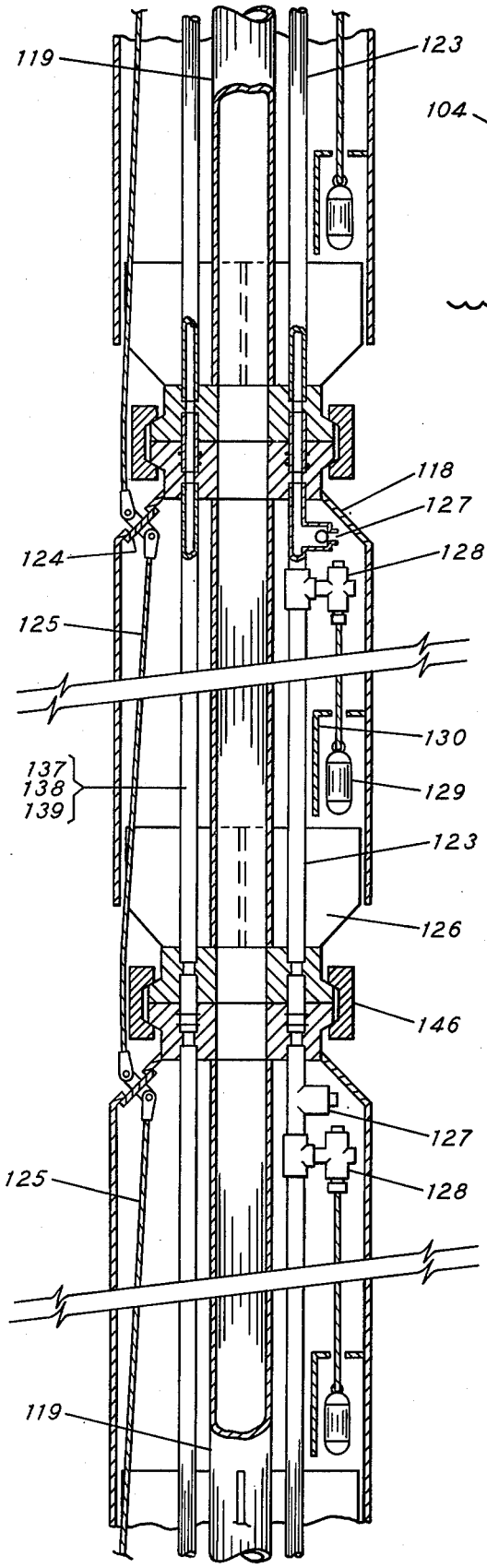
FIG. 5 is a schematic elevation of the open-bottom float can used in the embodiment shown in FIG. 4.
Figure 4:
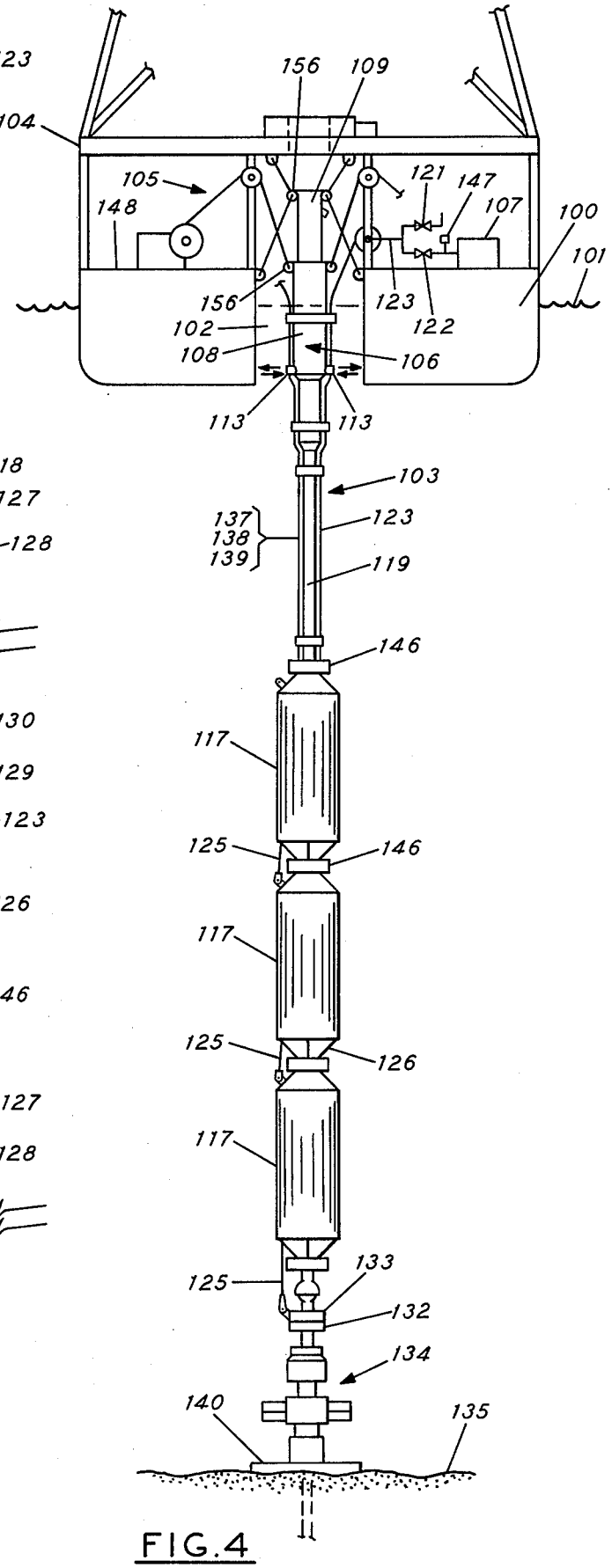
FIG. 4 is a schematic elevation illustrating another embodiment of the invention comprising a marine riser with multiple open-bottom float cans.
Figure 16:
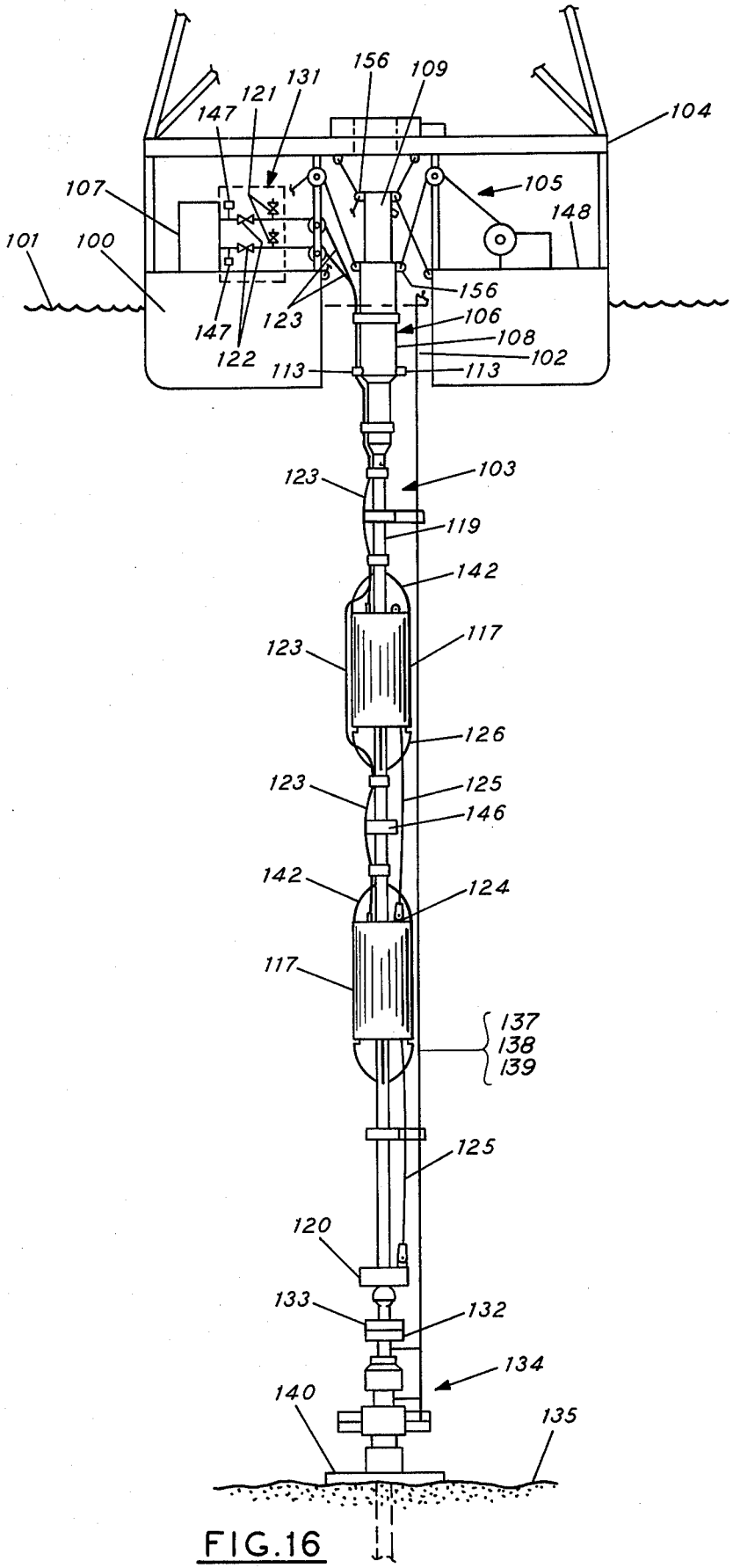
FIG. 16 is alternate embodiment of the invention with a single gas conduit connected to each float can and choke, kill and control conduits outside the float cans.

At the lower end of the riser is shown a counterweight 120, FIGS. 1 and 16. The counterweight 120 is optional since no additional or at most a minimum amount of additional weight is necessary to run the riser 103 down if the riser 103 is flooded. Kill line 137, choke line 138, and control line 139 are not shown in FIG. 1. Since they are essential to control blowouts, they may extend longitudinally through the float cans 117, as illustrated in FIGS. 4 and 5 or similarly outside the cans 117, as illustrated in FIG. 16. Further, since the riser 103 is put together in sections for ease in handling, the mechanism for connecting the sections together, clamp connectors 146, is shown.

As stated above, the supply of air under controllable pressure 107 is located on the vessel 100, FIG. 1. Immediately adjacent to the supply 107 is a means for selectively controlling the flow of air into and out of the float cans 117; such means in the preferred embodiment are a vent valve 121, an air flow valve 122 and a pressure regulator 147 in line with conduit means 123. The conduit means 123 has an outlet in each float can 117, shown in FIGS. 1, 2, 4 and 5.

Figure 2:
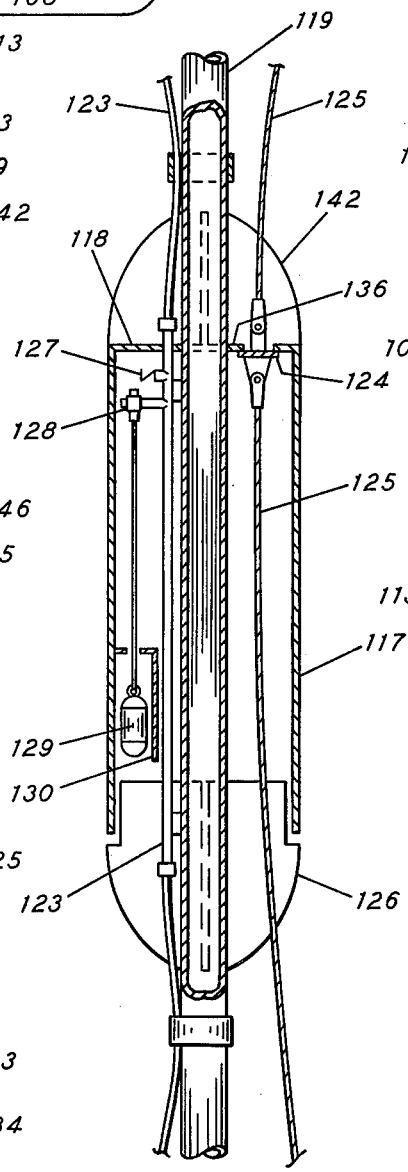
FIG. 2 is an elevation cross section of an intermediate open-bottom float can.
Figure 6:
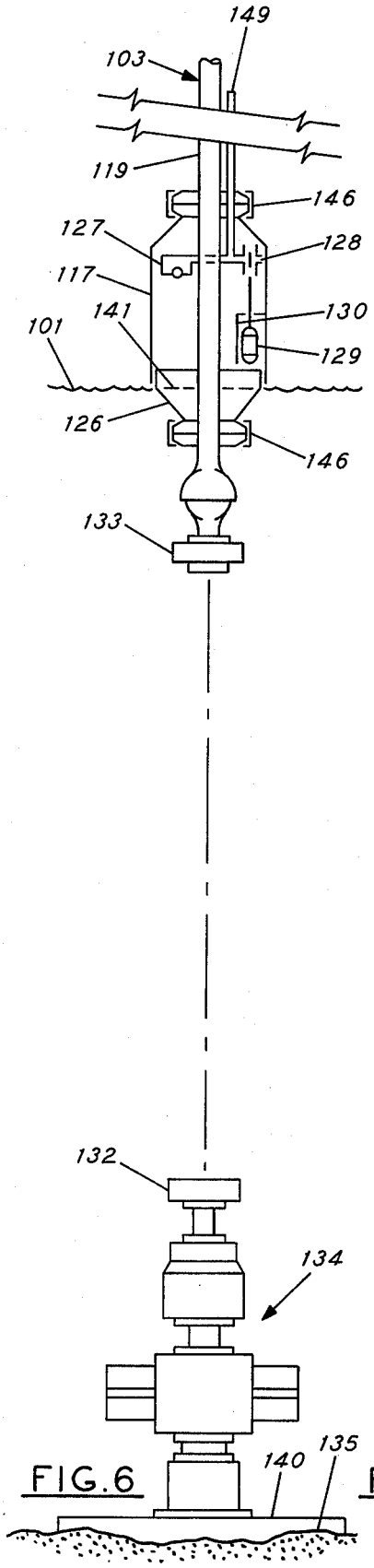
FIGS. 6 through 14 schematically illustrate the sequence of steps in a cycle of running, flooding and dewatering the invention at a drill site.
Figure 7:
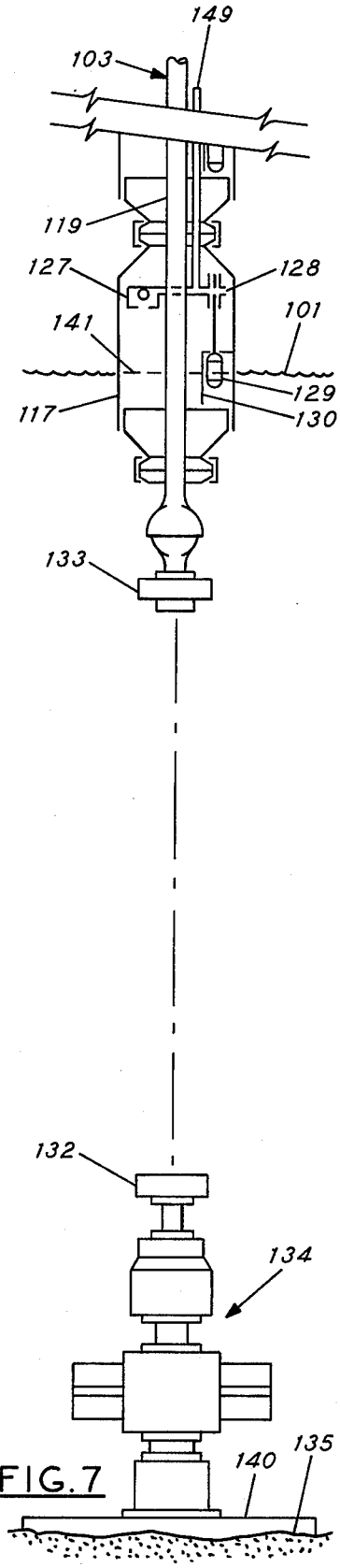
Figure 8:
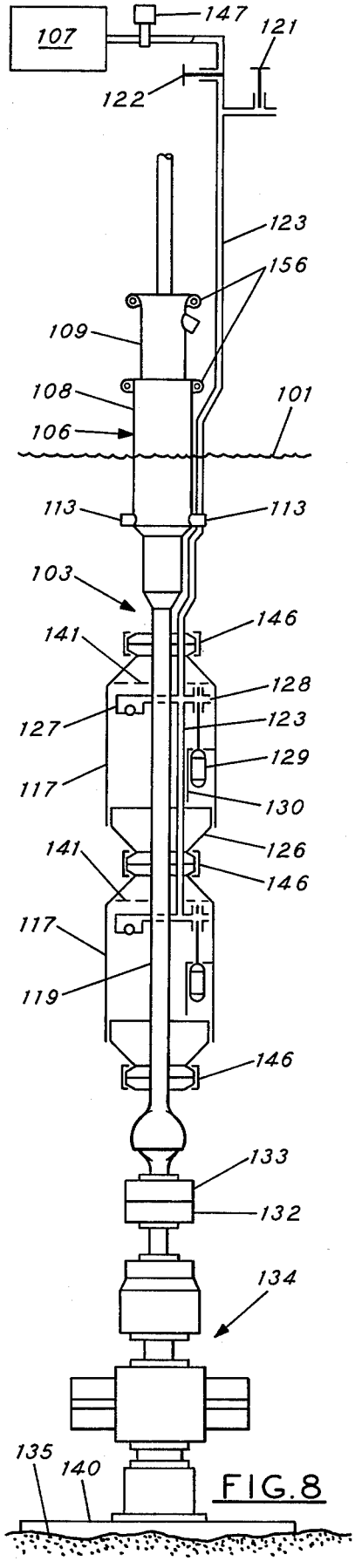

The outlet comprises a check valve 127 and a release valve 128 both connected to the conduit means 123, FIG. 2. The normally closed check valve 127 is held closed by the air pressure which flows into the float can 117; when the air is vented, the check valve 127 opens. Venting may occur by opening the control vent valve 121 on the deck 148 or simply through the open connection 149 of conduit 123, FIG. 6 and FIG. 7, before it is connected into the source of air 107.

The means for operating the release valve 128 is a float 129 connected to the valve 128; the short distance the float 129 is buoyed up by the water is limited preferably by a float cage 130 fastened to the interior of the float can 117. The float 129 opens the valve 128 at its uppermost height and closes the valve 128 at its lowermost height.

The air dump valve 124 and actuating means for operating the dump valve 124, i.e., the tag line 125 interconnecting adjacent air dump valves 124, is illustrated in FIGS. 2 and 5. The dump valve 124 is seated by magnetic means, a spring, clamps or other means all with a parting strength less than the ultimate strength of the tag line 125. In event of a riser parting, the tag line 125 forcibly pulls open the air dump valve 124 to release the air that is under pressure in each float can 117, FIG. 15. It is noted here that the dump valves 124 are a safety feature but are not absolutely necessary to use in this invention.

At the open end of the float can 117 are several expansion guiding means for axial travel such as vanes 126, FIGS. 2 and 5. These vanes 126 are welded or otherwise fastened to the riser pipe 119 to allow and guide the axial expansion and contraction of the open-bottom can 117.

An alternate embodiment, FIG. 16, may have instead of a single continuous conduit 123 several individual conduits 123; each attached at the source of buoyancy air 107 through a control manifold 131, a means for sequentially controlling fluid flow, and terminating in a singular float can 117. At the point of termination, there is an air check valve 127, an air release valve 128 and float 129 operating in the fashion described above. The dump valve 124, although not necessary, is advantageous to include as a safety feature. Further, the control manifold 131 may be a type that does not automatically and sequentially control air flow but one that is manually controlled. As mentioned above, a separate choke, kill and control line 137, 138 and 139 extends outside the float cans.

The following explains the method of using the preferred embodiment. The marine riser 103 is extended into a body of water 101 from the drilling vessel 100 without the conduit means 123 being connected to the source of air 107, FIG. 6. The bottommost float can 117 and the male portion 133 of a remotely actuated connector enter the water first. The male portion 133 reconnects to the female portion or the water bottom connector 132 of the remotely actuated connector which is secured to a blowout preventer stack 134 already located on the underwater bottom 135. This connection 132, 133 forms the water bottom connection. The invention may also be connected directly to a well head 140 when the blowout preventer stack (B.O.P) 134 is lowered with the riser 103.

When the riser 103 enters the water 101, the air supply valve 122, air release valve 128, and air check valve 127 are closed while the vent valve 121 is opened. As the riser 103 is progressively lowered into the water 101, the float can means 117 fills with water 141, and the air release valve 128 opens, FIG. 7. The conduit means 123 is then connected to the source of air 107 when either of the following occurs: the uppermost float can is almost entirely submerged, or the bottommost float can is a safe distance above the water bottom connector located on the B.O.P. or the wellhead if the B.O.P. is being lowered with the riser 103.

Figures 9, 10, 11:
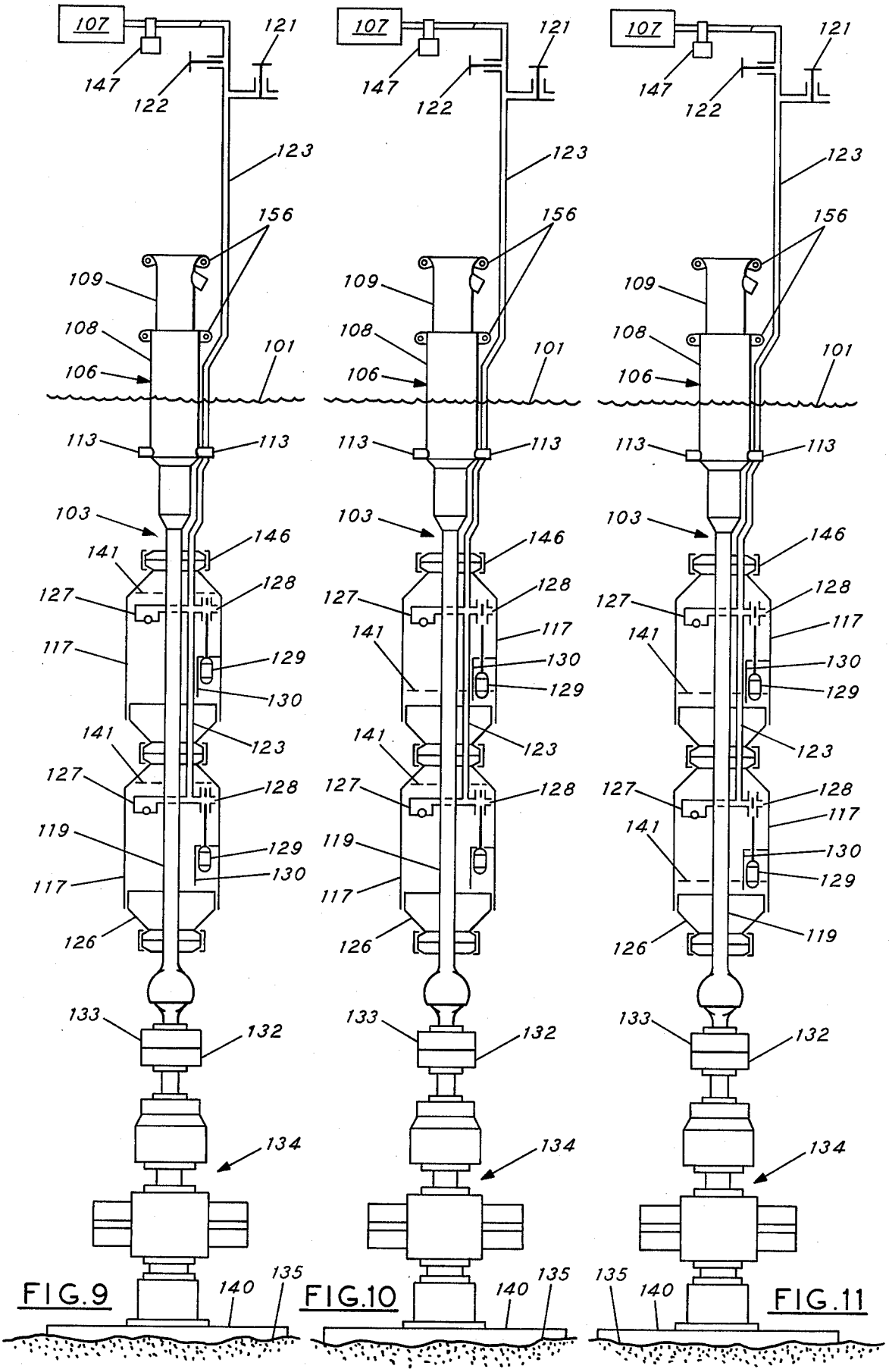

With the conduit means 123 connected to the air source 107, the riser is ready for the critical final lowering and subsequent anchoring to make the water bottom connection. After it is made, the vent valve 121 is closed; and air is injected under pressure through the conduit 123 entering the uppermost can 117 through the air release valve 128. The air release valve 128 is held open by the buoyancy of the float 129 illustrated in FIG. 9. During the dewatering sequence, the uppermost float can 117 is dewatered first since that can 117 has a lesser head of water exerted against it than any lower float can 117. Once the float can 117 is dewatered, the air release valve 128 is closed by the downward movement of the float 129 due to the lower water level, see FIG. 10. When the dewatering operation is completed, all the air release valves 128 are closed as illustrated in FIG. 11. It is evident from the foregoing that the need for bottom ballast and the complexities of special outfitting required to control the buoyant float cans is eliminated. The reason is that since the uppermost cans are filled first with pressurized gas making them buoyant, the riser is supported by them while the unfilled lower cans act like ballast to keep the riser vertical. Consequently, the riser is easier controlled since it does not take a horizontal or sloped position as would be the case if all the float cans were filled at the same time.

If the riser 103 is lowered without the use of motion compensating equipment, the proper running procedure for the riser 103 is to stop the descent of riser 103 a safe distance above the water bottom connector 132 to avoid impact with it. Then, the float cans 117 are manipulated for neutral buoyancy. Subsequently, a temporary lateral tie-in system not illustrated, is connected at the top of riser 103 to accommodate vessel motion; the tie-ins further function to support the riser. The riser 103 is then gradually lowered for anchoring while venting the air in the float cans 117. When connected, the dewatering is restarted to achieve the necessary riser tension. Additional tie-ins and supplementary tensioning may be secured before removing all running tools such as a drill pipe sub.

Figures 12, 13, 14:
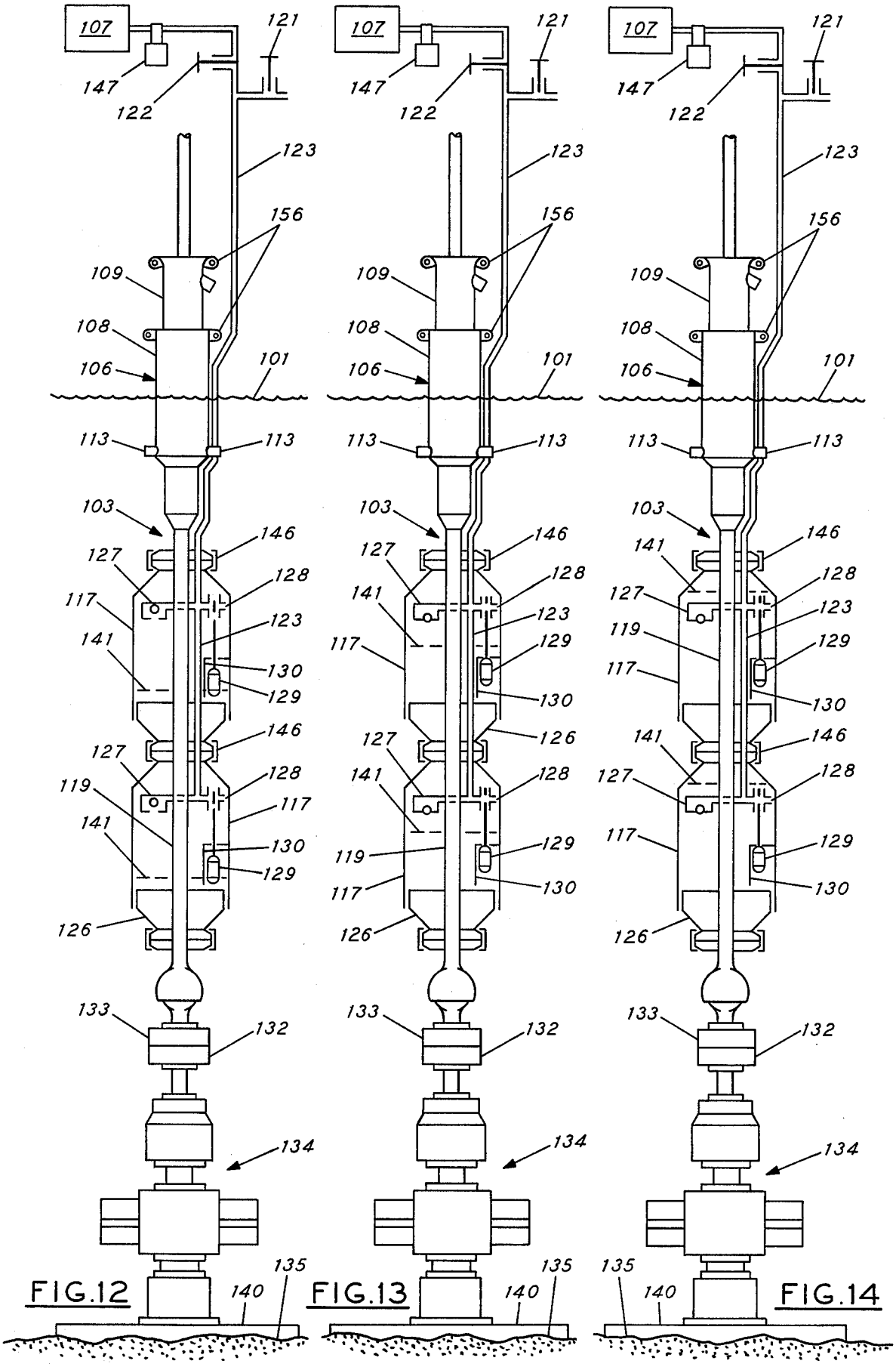

When the riser 103 is removed from the water bottom connection, the air supply valve 122 is first closed and the vent valve 121 is opened, FIG. 12. The air initially escapes from the can 117 through the air check valve 127 which is opened due to the release of air pressure exerted against the valve 127. With this exodus of the air, water flows into the can 117 as shown in FIG. 13 permitting the float 129 to buoy upward and open the air release valve 128, FIG. 14. Valve 128 remains open during the remaining flooding until all cans 117 are again dewatered. Using motion compensating gear, the riser 103 is disconnected at the water bottom connection and raised a safe distance above the female connector 132 to avoid impact with it. From this location, the riser 103 may be raised to the vessel 100 without the aid of the motion compensating gear.

A modified procedure for raising the riser 103 exists when raising the riser 103 without the motion compensating equipment. The air is adjusted to make the riser 103 slightly negatively buoyant; after which, the top of the riser 103 is stabilized, e.g., by upper stabilizing lines, to be independent of ship heave, slight riser lifting or other vertical movement. Then, the riser 103 is dewatered to achieve neutral buoyancy. After disconnection from the bottom connection, the riser 103 is quickly lifted by the buoyancy alone or other means until the riser 103 is safely above the water bottom connector 132. In this position, the upper stabilizing lines are removed. Subsequently, the riser 103 is raised to the vessel deck 148.

The terms and expressions used in the preceding are terms of description and not of limitation; there is no intention in the use of the terms and expressions to exclude any equivalents of the features shown and described which are feasible within the scope of the following claims.

What is claimed is:

1. A buoyantly tensioned riser pipe in a body of water comprising:

an elongated riser pipe having a substantially central opening therethrough;

means for securing the upper end of said riser pipe to a drilling platform located in said water;

means for securing the lower end of said riser pipe to a water bottom connector;

float can means having a closed upper end and an open bottom end;

means for connecting the upper end of said float can means to said riser pipe concentrically, wherein said means for connecting is able to withstand a pressure exerted against said means for connecting;

a source of gas under pressure;

conduit means connecting said source of gas to the upper end of said float can means for injecting gas into said float can means whereby said gas is trapped in the closed upper end of said float can means to buoyantly tension said pipe;

a plurality of expansion guiding means connected to said riser pipe at the open end of said float can means for guiding said float can means along said guiding means during expansion and contraction of said float can means;

a normally closed fluid dump valve connected to the upper closed end of said float can means;

actuating means for operating said valve to open said dump valve in each of said float can means when said riser pipe parts;

slip joint means operatively connected to said drilling platform and said riser for allowing said riser to slide up and down;

supplementary tensioning means for providing additional tension when a water current is encountered;

means for connecting said supplementary tensioning means to said riser; and a plurality of lines for killing, choking and controlling a well under said body of water extending longitudinally through said float can means.

2. The buoyantly tensioned riser pipe of claim 1 further characterized by a vent valve connected to the upper end of said conduit means for controlling the flow of gas out of said float can means; a gas supply valve in the conduit means between said source of gas and said float can means; and a pressure regulator to control the flow of said gas into said float can means.

3. The buoyantly tensioned riser pipe of claim 1 further characterized by a gas check valve located in said float can means operatively connected to said conduit means whereby said check valve allows the escape of gas through said conduit and is shut when said fluid flows through said conduit;

a gas release valve in said float can means operatively connected to said conduit means; and means for operating said release valve so as to permit said gas to flow into and out of said float can means when desired.

4. The buoyantly tensioned riser pipe of claim 1 wherein said guiding means are metal vanes welded to said riser.

5. The buoyantly tensioned riser pipe of claim 1 wherein said means for operating said release valve comprises a float connected to said valve.

6. The buoyantly tensioned riser pipe of claim 1 wherein said slip joint comprises:

a stinger having a bore designed to permit articles to pass therethrough;

an outer body having bore designed to permit said outer body to slide therein;

means for securing said outer body to said drilling platform and to said riser pipe so as to keep said outer body concentric with said stinger;

port means in said lower tube for permitting said water to flow in and out of said lower tube; and a fluid impregnable tubular seal attached below said port means to the interior of said outer body allowing said stinger to slide through said seal without permitting fluid to penetrate said seal.

7. The buoyantly tensioned riser pipe of claim 6 wherein said stinger comprises an open ended cylinder of a large diameter fastened to a lower, open ended cylinder of a smaller diameter; and said outer body comprises an open ended cylinder of a large diameter fastened to a lower, open ended cylinder of a smaller diameter.

8. The buoyantly tensioned riser pipe of claim 6 further characterized by means is said slip joint for limiting the relative movement of said stinger and said outer body to prevent blocking said port means;

and means for keeping said stinger from separating from said outer body in the event said outer body parts below said keeping means.

9. The buoyantly tensioned riser pipe of claim 6 further characterized by a means for limiting the distance said float is buoyed by water in said float can means.

10. A marine riser that is buoyantly and controllably tensioned by open-bottom float cans comprising:

an elongated riser pipe having a substantially central opening therethrough;

a slip joint at the upper end of said riser wherein said slip joint has a stinger having a bore designed to permit articles to pass therethrough and an outer body with a bore designed to permit said stinger to slide therein;

means for securing said outer body to a drilling platform and said riser pipe so as to keep said outer body concentric with said stinger;

means for securing said stinger to said drilling platform;

port means in said outer body for permitting water to flow in and out of said outer body;

a fluid impregnable tubular seal attached to the interior of said outer body below said port means allowing said stinger to slide through said seal without permitting water to penetrate said seal;

means in said slip joint for limiting the relative movement of said stinger and said outer body to prevent blocking said port means;

means for keeping said outer body from separating from said stinger when said riser parts below said means for keeping;

supplementary tensioning means for providing additional tensioning when required;

means for connecting said supplementary tensioning system to said slip joint;

a plurality of float cans having a closed upper end and an open bottom end;

means for connecting upper end of said float cans to said riser pipe;

a source of compressed air;

a conduit operatively connecting said source of compressed air to the upper end of each of said float cans for injecting said air into said float cans whereby said air is trapped in the closed upper end of said float can to buoyantly tension said riser pipe;

a normally closed air dump valve connected to the upper closed end of each of said float cans;

a tag line interconnecting adjacent air dump valves in order to open said air dump valves when said riser parts, said tag line connected to a water bottom connector;

an air check valve located in each of said float cans operatively connected to said conduit whereby said check valve allows the escape of air through said conduit and is shut when said air flows through said conduit;

an air release valve in each of said float cans operatively connected to said conduit;

a float connected to said air release valve to operate said air release valve by the distance said float is buoyed by water in said float can;

a float cage for limiting the distance said float is buoyed in said float can;

a plurality of radial vanes wherein one edge of each of said vanes is connected to said riser pipe at the open end of each of said float cans, the opposite edge of each of said vanes being free to guide said float can during expansion and contraction;

a vent valve connected to the upper end of said conduit for controlling the flow of air cut of each of said float cans;

an air supply valve in the conduit between said source of compressed air and said plurality of float cans to control the flow of said air into said float cans;

a means for connecting said riser to the water bottom connector; and a plurality of lines for killing, choking and controlling a well under said body of water extending longitudinally through said float cans.

11. An improvement for buoyantly tensioning a marine riser of the type wherein said riser is lowered into a body of water and secured at the upper end to a drilling platform and the lower end is secured to a wellhead, comprising:

a plurality of float can means having a closed upper end and an open-bottom end, said plurality of float cans located along said riser pipe at predetermined locations so that there is an uppermost float can means and a lowermost float can means when said riser pipe is placed in a substantially vertical position;

means for respectively connecting the upper end of each of said float can means to said riser pipe, wherein said means for connecting is able to withstand a fluid pressure;

a source of gas under pressure; and conduit means operatively connecting said gas source to the upper end of said float can means for injecting gas into each of said float can means so that said uppermost float can means are filled first whereby said gas is trapped within said float can means to assist in buoyantly tensioning said riser pipe so that better and quicker control of the riser pipe results since the uppermost float can means buoyantly supports said riser pipe while said lowermost float can means ballast said riser pipe to keep said riser pipe substantially vertical while said riser pipe is being buoyantly tensioned.

12. The improvement for buoyantly tensioning a marine riser of claim 11 further characterized by valve means connected to said conduit means and located within each of said float can means in the vicinity of the upper end of each of said float can means, said valve means for selectively controlling the flow of gas into and out of said float can means in order to permit wet running of said float can means into the body of water so that said conduit means is used at different times as both a flowline for gas to buoyantly tension said riser and a bleed line for selectively removing gas within said float can means thereby eliminating the need for separate bleed and fill lines.

13. The improvement for buoyantly tensioning a marine riser of Claim 11 further characterized by a plurality of expansion guiding means connected to said riser pipe at the open end of said float can means for guiding said float can means during expansion and contraction of said float can means.

14. The improvement for buoyantly tensioning a marine riser of Claim 11 further characterized by a normally closed gas dump valve connected to the upper closed end of said float can means; and actuating means for opening said dump valve of each of said float can means located above where said riser pipe parts and keeping closed said dump valve of each of said float can means located below where said riser parts, whereby said actuating means releases pressurized gas in said float cans above where said riser parts so as to lessen impact against said drilling platform and maintains pressurized gas in said float can means below where said riser parts.

15. The improvement for buoyantly tensioning a marine riser of claim 11 further characterized by a slip joint connected at the upper end of said riser comprising:

a stinger having a bore designed to permit articles to pass therethrough;

means for securing said stinger to said drilling platform;

an outer body with a bore designed to permit said stinger to slide therein;

means for securing said outer body to said drilling platform and said riser pipe so as to keep said outer body concentric with said stinger;

port means in said outer body for permitting said water to flow in and out of said outer body; and a fluid impregnable tubular seal attached below said port means and to the interior side of said outer body which permits said stinger to slide through said seal without permitting fluid to pass said seal.

16. The buoyantly tensioned riser pipe of claim 11 wherein said conduit means comprises a separate conduit means operatively connecting said gas source to the upper end of each of said float can means; and means for controlling fluid flow through each of said conduit means.

17. The improvement for buoyantly tensioning a marine riser of Claim 11 further characterized by a plurality of lines for killing, choking and controlling a well under said body of water extending longitudinally through said float can means.

18. The improvement for buoyantly tensioning a marine riser of Claim 11 further characterized by a plurality of lines for killing, choking and controlling a well under said body of water extending longitudinally outside said float can means.

19. A method of buoyantly tensioning a marine riser with open bottom float can means wherein said riser is connected at the upper end to a drilling platform floating in a body of water comprising the steps of:

connecting a gas conduit to the upper end of said float can means so that said gas conduit has an opening located in the vicinity of the upper end of said float can means;

selectively opening said gas conduit to vent gas trapped in said float can means through said gas conduit opening which is located in the vicinity of the upper end of said float can means, so as to permit water freely to enter said float can means as said riser is progressively lowered into the water;

lowering said riser and gas conduit into the water from said drilling platform;

anchoring said riser to a water bottom connector;

closing said gas conduit vent; and injecting gas with a density less than water under pressure through said gas conduit and into said float can means to displace water in said float can means in order to buoyantly tension said riser, said upper float can means filling first since the water pressure at the upper end of said can means is lower than the water pressure at the lower end of said float can means.

20. The method of claim 19 wherein the step of selectively opening said gas conduit is done before lowering said riser into the water.

21. The method of claim 19 wherein the step of selectively opening said gas conduit is done after lowering said riser into the water.

22. The method of claim 19 including the steps of:

stopping the riser a distance above the water bottom connector so as to avoid impact with said connector due to water surface motion of said drilling platform;

closing a gas vent valve operatively connected to said float can means;

supplying gas with a density less than water to said float can means to achieve neutral buoyancy;

lowering said riser for connection to said water bottom connector;

anchoring said riser to said water bottom connector; and increasing the gas in said float can means to provide the desired tension.

23. The method of claim 19 including the steps of:

stopping the riser a distance above the water bottom connector so as to avoid impact with said connector due to water surface motion;

and engaging motion compensating equipment before anchoring said riser.

24. A method of buoyantly tensioning a marine riser with open bottom float can means wherein said riser is connected at the upper end to a drilling platform floating in a body of water comprising the steps of:

connecting a gas conduit to the upper end of said float can means so that said gas conduit has an opening located in the vicinity of the upper end of said float can means;

selectively opening said gas conduit to vent gas trapped in said float can means through said gas conduit opening, which is located in the vicinity of the upper end of said float can means, so as to permit water to enter said float can means as said riser is progressively lowered into the water;

lowering said riser and gas conduit into the water from said drilling platform;

anchoring said riser to a water bottom connector;

closing said gas conduit vent; and injecting gas with a density less than water under pressure through said gas conduit and into the upper end of said float can means to displace water from the bottom of said float can means in order to buoyantly tension said riser; and ballasting said riser with a deadweight before placing said riser into said water.

25. The method of claim 19 including the step of engaging motion compensation equipment a distance above the water bottom connector; and gently lowering said riser to said water bottom connector.

26. The method of claim 19 including the step of providing lateral ties at the top of said riser in order to keep said riser in proper position relative to said drilling platform.

27. A method of buoyantly tensioning a marine riser with open bottom float can means wherein said riser is connected at the upper end to a drilling platform in a body of water comprising the steps of:

opening a gas conduit vent operatively connected to the upper end of said float can means;

ballasting said riser;

extending said ballasted riser into a body of water;

anchoring said riser to the water bottom connector;

providing a gas under pressure with a density less than water under pressure to said float can means to buoyantly tension said riser; and maintaining said gas in said float can means to sustain tension in said riser.

28. A buoyantly tensioned riser pipe for use in a body of water comprising:

an elongated riser pipe having a substantially central opening therethrough;

means for securing the upper end of said riser pipe to a drilling platform located in the body of water;

means for securing the lower end of said riser pipe to a water bottom connector;

float can means having a closed upper end and an open bottom end;

means for connecting the upper end of said float can means to said riser pipe, wherein said means for connecting is able to withstand a fluid pressure;

a source of buoyancy gas under pressure;

a plurality of expansion guiding means connected to said riser pipe at the open end of said float can means for guiding said float can means along said guiding means during expansion and contraction of said float can means; and conduit means operatively connecting said gas source to the upper end of said float can means for directly injecting gas into said float can means in the vicinity of the upper end of said float can means so that water is positively displaced downwardly as gas is injected and trapped within said float can means to assist in buoyantly tensioning said riser pipe whereby better and quicker control of said riser pipe results since said float can means takes less time to fill than when filled with gas from the bottom up.

29. A buoyantly tensioned riser pipe for use in a body of water comprising:

an elongated riser pipe having a substantially central opening therethrough;

means for securing the upper end of said riser pipe to a drilling platform located in the body of water;

means for securing the lower end of said riser pipe to a water bottom connector;

float can means having a closed upper end and an open bottom end;

means for connecting the upper end of said float can means to said riser pipe, wherein said means for connecting is able to withstand a fluid pressure;

a source of buoyancy gas under pressure;

a normally closed gas dump valve connected to the upper closed end of said float can means;

actuating means for opening said dump valve of said float can means located above where said riser pipe parts and for keeping said dump valves closed below where said riser parts, whereby said actuating means releases pressurized gas in said float cans above where said riser parts so as to lessen impact against said drilling platform and maintain pressurized gas in said float cans below where said riser parts; and conduit means operatively connecting said gas source to the upper end of said float can means for directly injecting gas into said float can means in the vicinity of the upper end of said float can means so that water is positively displaced downwardly as gas is injected and trapped within said float can means to assist in buoyantly tensioning said riser pipe whereby better and quicker control of said riser pipe results since said float can means takes less time to fill than when filled with gas from the bottom up.

30. A buoyantly tensioned riser pipe for use in a body of water comprising:

an elongated riser pipe having a substantially central opening therethrough;

means for securing the upper end of said riser pipe to a drilling platform located in the body of water;

means for securing the lower end of said riser pipe to a water bottom connector;

float can means having a closed upper end and an open bottom end;

means for connecting the upper end of said float can means to said riser pipe, wherein said means for connecting is able to withstand a fluid pressure;

a source of buoyancy gas under pressure;

a slip joint connected at the upper end of said riser, said slip joint comprising:

a stinger having a bore designed to permit articles to pass therethrough;

means for securing said stinger to said drilling rig;

an outer body with a bore designed to permit said stinger to slide therein;

means for securing said outer body to said drilling platform and said riser pipe so as to keep said outer body concentric with said stinger;

port means in said outer body for permitting water to flow in and out of said outer body; and a fluid impregnable tubular seal attached below said port means and to the interior side of said outer body which permits said stinger to slide through said seal without permitting fluid to pass said seal; and conduit means operatively connecting said gas source to the upper end of said float can means for directly injecting gas into said float can means in the vicinity of the upper end of said float can means so that water is positively displaced downwardly as gas is injected and trapped within said float can means to assist in buoyantly tensioning said riser pipe whereby better and quicker control of said riser pipe results since said float can means takes less time to fill than when filled with gas from the bottom up.

31. A buoyantly tensioned riser pipe for use in a body of water comprising:

an elongated riser pipe having a substantially central opening therethrough;

means for securing the upper end of said riser pipe to a drilling platform located in the body of water;

means for securing the lower end of said riser pipe to a water bottom connector;

float can means having a closed upper end and an open bottom end;

means for connecting the upper end of said float can means to said riser pipe, wherein said means for connecting is able to withstand a fluid pressure;

a source of buoyancy gas under pressure;

supplementary tensioning means for keeping said riser under control while lowering said riser to make a connection to a water bottom connector in the event additional tensioning is required;

means for connecting said supplementary tension system to said riser pipe; and conduit means operatively connecting said gas source to the upper end of said float can means for directly injecting gas into said float can means in the vicinity of the upper end of said float can means so that water is positively displaced downwardly as gas is injected and trapped within said float can means to assist in buoyantly tensioning said riser pipe whereby better and quicker control of said riser pipe results since said float can means takes less time to fill than when filled with gas from the bottom up.

32. A buoyantly tensioned riser pipe for use in a body of water comprising:

an elongated riser pipe having a substantially central opening therethrough;

means for securing the upper end of said riser pipe to a drilling platform located in the body of water;

means for securing the lower end of said riser pipe to a water bottom connector;

float can means having a closed upper end and an open bottom end;

means for connecting the upper end of said float can means to said riser pipe, wherein said means for connecting is able to withstand a fluid pressure;

a source of buoyancy gas under pressure;

conduit means operatively connecting said gas source to the upper end of said float can means for directly injecting gas into said float can means in the vicinity of the upper end of said float can means so that water is positively displaced downwardly as gas is injected and trapped within said float can means to assist in buoyantly tensioning said riser pipe whereby better and quicker control of said riser pipe results since said float can means takes less time to fill than when filled with gas from the bottom up;

valve means connected to said conduit means for selectively controlling the flow of gas into and out of said float can means in the vicinity of the upper end of said float can means in order to permit wet running of said float can means into the body of water, said conduit means is usable at different times, as both a flowline for gas to buoyantly tension said riser and bleed line to selectively remove gas within said float can means thereby eliminating the need for separate bleed and fill gas lines;

a gas check valve located in said float can means operatively connected to said conduit means whereby said check valve allows the escape of gas through said conduit and is shut when said gas flows through said conduit means;

a gas release valve in said float can means operatively connected to said conduit means; and means for operating said release valve so as to permit said gas to flow into and out of said float can means when desired.

33. A buoyantly tensioned riser pipe for use in a body of water comprising:

an elongated riser pipe having a substantially central opening therethrough;

means for securing the upper end of said riser pipe to a drilling platform located in the body of water;

means for securing the lower end of said riser pipe to a water bottom connector;

float can means having a closed upper end and an open bottom end;

means for connecting the upper end of said float can means to said riser pipe, wherein said means for connecting is able to withstand a fluid pressure;

a source of buoyancy gas under pressure;

a plurality of expansion guiding means connected to said riser pipe at the open end of said float can means for guiding said float can means along said guiding means during expansion and contraction of said float can means wherein said guiding means is a plurality of metal vanes welded along one edge of said vane to said riser and the opposite edge of each of said vanes being free to guide said float can means during expansion and contraction of said float can means; and conduit means operatively connecting said gas source to the upper end of said float can means for directly injecting gas into said float can means in the vicinity of the upper end of said float can means so that water is positively displaced downwardly as gas is injected and trapped within said float can means to assist in buoyantly tensioning said riser pipe whereby better and quicker control of said riser pipe results since said float can means takes less time to fill than when filled with gas from the bottom up.

34. A buoyantly tensioned riser pipe for use in a body of water comprising:

an elongated riser pipe having a substantially central opening therethrough;

means for securing the upper end of said riser pipe to a drilling platform located in the body of water;

means for securing the lower end of said riser pipe to a water bottom connector;

float can means having a closed upper end and an open bottom end;

means for connecting the upper end of said float can means to said riser pipe, wherein said means for connecting is able to withstand a fluid pressure;

a source of buoyancy gas under pressure;

a slip joint connected at the upper end of said riser, said slip joint comprising:

a stinger having a bore designed to permit articles to pass therethrough wherein said stinger comprises an open-ended cylinder of a large diameter fastened to a lower open-ended cylinder of a smaller diameter;

means for securing said stinger to said drilling rig;

an outer body with a bore designed to permit said stinger to slide therein, said outer body comprises an open-ended cylinder of a large diameter fastened to a lower open-ended cylinder of a smaller diameter;

means for securing said outer body to said drilling platform and said riser pipe so as to keep said outer body concentric with said stinger;

port means in said outer body for permitting water to flow in and out of said outer body; and a fluid impregnable tubular seal attached below said port means and to the interior side of said outer body which permits said stinger to slide through said seal without permitting fluid to pass said seal; and conduit means operatively connecting said gas source to the upper end of said float can means for directly injecting gas into said float can means in the vicinity of the upper end of said float can means so that water is positively displaced downwardly as gas is injected and trapped within said float can means to assist in buoyantly tensioning said riser pipe whereby better and quicker control of said riser pipe results since said float can means takes less time to fill than when filled with gas from the bottom up.

35. A buoyantly tensioned riser pipe for use in a body of water comprising:

an elongated riser pipe having a substantially central opening therethrough;

means for securing the upper end of said riser pipe to a drilling platform located in the body of water;

means for securing the lower end of said riser pipe to a water bottom connector;

float can means having a closed upper end and an open bottom end;

means for connecting the upper end of said float can means to said riser pipe, wherein said means for connecting is able to withstand a fluid pressure;

a source of buoyancy gas under pressure;

a slip joint connected at the upper end of said riser, said slip joint comprising:

a stinger having a bore designed to permit articles to pass therethrough;

means for securing said stinger to said drilling rig;

an outer body with a bore designed to permit said stinger to slide therein;

means for securing said outer body to said drilling platform and said riser pipe so as to keep said outer body concentric with said stinger;

port means in said outer body for permitting water to flow in and out of said outer body;

means in said slip joint for limiting the relative movement of said outer body and said stinger to prevent blocking said port means;

means for keeping said outer body from separating from said stinger when said outer body parts below said keeping means; and a fluid impregnable tubular seal attached below said port means and to the interior side of said outer body which permits said stinger to slide through said seal without permitting fluid to pass said seal; and conduit means operatively connecting said gas source to the upper end of said float can means for directly injecting gas into said float can means in the vicinity of the upper end of said float can means so that water is positively displaced downwardly as gas is injected and trapped within said float can means to assist in buoyantly tensioning said riser pipe whereby better and quicker control of said riser pipe results since said float can means takes less time to fill than when filled with gas from the bottom up.

36. A buoyantly tensioned riser pipe for use in a body of water comprising:

an elongated riser pipe having a substantially central opening therethrough;

means for securing the upper end of said riser pipe to a drilling platform located in the body of water;

means for securing the lower end of said riser pipe to a water bottom connector;

float can means having a closed upper end and an open bottom end;

means for connecting the upper end of said float can means to said riser pipe, wherein said means for connecting is able to withstand a fluid pressure;

a source of buoyancy gas under pressure;

conduit means operatively connecting said gas source to the upper end of said float can means for directly injecting gas into said float can means in the vicinity of the upper end of said float can means so that water is positively displaced downwardly as gas is injected and trapped within said float can means to assist in buoyantly tensioning said riser pipe whereby better and quicker control of said riser pipe results since said float can means takes less time to fill than when filled with gas from the bottom up;

valve means connected to said conduit means for selectively controlling the flow of gas into and out of said float can means in the vicinity of the upper end of said float can means in order to permit wet running of said float can means into the body of water, said conduit means is usable at different times, as both a flowline for gas to buoyantly tension said riser and bleed line to selectively remove gas within said float can means thereby eliminating the need for separate bleed and fill gas lines;

a gas check valve located in said float can means operatively connected to said conduit means whereby said check valve allows the escape of gas through said conduit and is shut when said gas flows through said conduit means;

a gas release valve in said float can means operatively connected to said conduit means; and a float connected to said release valve for operating said release valve so as to permit said gas to flow into and out of said float can means when desired.

37. The buoyantly tensioned riser pipe of claim 36 further characterized by a means for limiting the distance said float is buoyed by water in said float can means.

* * * * *

UNITED STATES PATENT AND TRADEMARK OFFICE

CERTIFICATE OF CORRECTION

PATENT NO. : 4,099,560

DATED : July 11, 1978

INVENTOR(S) : William Fischer and Virgil D. Rogge

It is certified that error appears in the above-identified patent and that said Letters Patent are hereby corrected as shown below:

Col. 1, line 2, should read --continuation--, not "continuation division".

Col. 10, line 34, "air cut" should read --air out--.

Claim 6 should be numbered --Claim 5--.

Claim 7 should be numbered --Claim 6--.

Claim 8 should be numbered --Claim 7--.

Claim 5 should be numbered --Claim 8--.

Col. 9, line 19, "claim 6" should read --claim 5--;
line 26, "claim 6" should read --claim 5--;
line 33, "claim 6" should read --claim 8--.

Signed and Sealed this

*Thirtieth* Day of *January 1979*

[SEAL]

*Attest:*

RUTH C. MASON
*Attesting Officer*

DONALD W. BANNER
*Commissioner of Patents and Trademarks*